US006559745B2

(12) United States Patent
Yamagata et al.

(10) Patent No.: US 6,559,745 B2
(45) Date of Patent: May 6, 2003

(54) CIRCUIT BREAKER, AND ACCESSORY SWITCHES THEREOF

(75) Inventors: Hideto Yamagata, Saitama (JP); Naoshi Uchida, Saitama (JP); Koji Asakawa, Saitama (JP); Kentaro Toyama, Tokyo (JP); Koji Nomura, Saitama (JP)

(73) Assignee: Fuji Electric Co., Ltd., Kanagausa (JP)

( * ) Notice: Subject to any disclaimer, the term of this patent is extended or adjusted under 35 U.S.C. 154(b) by 0 days.

(21) Appl. No.: 09/943,529

(22) Filed: Aug. 30, 2001

(65) Prior Publication Data

US 2002/0079992 A1 Jun. 27, 2002

(30) Foreign Application Priority Data

Sep. 4, 2000 (JP) ..... 2000-266484

(51) Int. Cl.[7] ..... H01H 67/02
(52) U.S. Cl. ..... 335/132; 335/172
(58) Field of Search ..... 335/6, 8–10, 167–172, 335/130–133, 202; 200/293–308

(56) References Cited

U.S. PATENT DOCUMENTS 4,774,484 A * 9/1988 Lehman et al. ..... 335/197
4,831,221 A * 5/1989 Yu et al. ..... 200/553
5,107,236 A * 4/1992 Lesslie et al. ..... 335/132
5,907,461 A * 5/1999 Hartzel et al. ..... 361/42
6,222,143 B1 * 4/2001 Lawson et al. ..... 200/401

* cited by examiner

*Primary Examiner*—Lincoln Donovan
*Assistant Examiner*—Tuyen T. Nguyen
(74) *Attorney, Agent, or Firm*—Pearne & Gordon LLP

(57) ABSTRACT

In relation to a circuit breaker, a left-side accessory switch storage section and a right-side accessory switch storage section are provided in a breaker case 1. A contact point of an ancillary switch 7 provided in one of the accessory switch storage sections is opened or closed in conjunction with an output protrusion 6*a* formed on an open-close lever 6 of an open-close mechanism section 3 on the main unit. A contact point of an alarm switch 9 provided in the remaining accessory switch storage section is opened or closed in conjunction with an alarm output plate 8 which operates in association with tripping action of the breaker. The output protrusion 6*a* is caused to oppose an operation lever 7*a* of an ancillary switch which is formed into a symmetrical bifurcated shape and which is provided in the accessory switch storage section. The alarm output plate constitutes a pivotal lever coupled to a toggle shaft 3*a* of the open-close mechanism section. An output protrusion 8*a* provided at the extremity of the pivotal lever is caused to oppose an operation lever 9*a* of the alarm switch provided in the accessory switch storage section.

2 Claims, 5 Drawing Sheets

CIRCUIT BREAKER, AND ACCESSORY SWITCHES THEREOF

BACKGROUND OF THE INVENTION

1. Technical Field

The present invention is intended for a molded case circuit breaker for protecting a low-tension power distribution facility, such as an electric motor, from an overcurrent. The present invention relates to interior accessories (e.g., optional components), such as an ancillary switch for detecting the ON/OFF status of a primary circuit contact point and a tripping action, a circuit breaker equipped with an alarm switch, and their accessory switches.

2. Related Art

As shown in FIG. 7, reference numeral 1 designates a case (plastic mold case) of a circuit breaker. The case 1 houses a breaking section 2 of a main circuit, a toggle-link-type open-close mechanism section 3, and a tripping section 4. The open-close mechanism section 3 is coupled to an assembly (not shown) of a movable contact of the breaking section 2 in combination with an open-close lever 6. The open-close lever 6 is pivotally actuated by means of actuation of the open-close mechanism section 3, thus switching the contact of the main circuit. When a handle 5 is manually moved to an ON/OFF position, a toggle link mechanism of the open-close mechanism section 3 is actuated, thereby opening or closing the contact of the main circuit of the breaking section 3. As is well known, in the event of inflow of an overcurrent to the main circuit, the open-close mechanism section 3 causes tripping section in accordance with a signal output from the tripping section 4, thus opening the contact of the main circuit.

Accessory switch housing sections 1*a* and 1*b* are provided side-by-side on the upper surface of the case 1. An ancillary switch 7 and an alarm switch 9, which are of cassette type, are to be connected to the respective accessory switch housing sections 1*a* and 1*b*.

In addition to the pivotal open-close lever 6 which opens and closes the contact of the main circuit of the breaking section 2, the open-close mechanism 3 of the breaker main unit is provided with an alarm output plate 8 which is slid in conjunction with tripping operation of the breaker. Two pairs of output protrusion 6*a* and output plate 8*a* are provided such that one pair protrudes so as to oppose one of the accessory switch housing sections 1*a* and 1*b* and such that the other pair protrudes so as to oppose the remaining accessory switch housing section. The output protrusion 6*a* of the open-close lever 6 and the output protrusion 8*a* of the alarm output plate 8 are provided side-by-side so as not to cause interference therebetween.

FIGS. 8A through 8C show the buildup structure of the open-close mechanism section 3. The open-close lever 6 pivots around a spindle 6*b* by means of operation of the open-close mechanism section 3. In synchronism with pivotal movement of the open-close lever 6, a pair projection which consist of the left-side and right-side output projections 6*a* and project from a frame of the open-close mechanism section move vertically. The alarm output plate 8 effects guiding and supporting action in a vertically movable manner along the frame of the open-close mechanism section 3. In a steady state, the alarm output plate 8 is retained and locked in an illustrated lower position. A latch is disengaged from a latch receiver 3*a* of the open-close mechanism section 3 in accordance with an output from the tripping section 4 (see FIG. 7), thereby causing tripping operation. As a result, a toggle shaft 3*b* of the open-close mechanism section causes pivotal movement, thus releasing the alarm output plate 8 from a locked state. The alarm output plate 8 is susceptible to spring force of a constriction spring 8*b*, thereby causing upward sliding action. As a result, the output projections 8*a* formed on both legs of the alarm output plate 8 are moved upwardly.

The ancillary switch 7 and the alarm switch 9 provided in the accessory switch housing sections 1*a* and 1*b* are constructed such that operation levers coupled to movable contacts project from the front surface of a unit case having a contact mechanism incorporated therein. In a state in which the ancillary switch 7 and the alarm switch 9 are provided in the breaker case 1 (see FIGS. 7A and 7B), an operation lever projecting from the ancillary switch 7 opposes the output protrusion 7*a* of the open-close lever 6, and an operation lever projecting from the alarm switch 9 opposes the output protrusion 8*a* of the alarm output plate 8. When the circuit breaker is turned ON/Off or tripped, a mechanical signal is transmitted to the ancillary switch 7 by way of the output protrusion 6*a* of the open-close lever 6, and a mechanical signal is transmitted to the alarm switch 9 by way of the alarm output plate 8. As a result, the switches are actuated in accordance with the signals, thus outputting electric signals to the outside of the circuit breaker.

The illustrated example shows a case where the alarm switch 9 and the ancillary switch 7 are provided in the accessory switch housing sections 1*a* and 1*b* of the case 1. There may also be possible to use the circuit breaker by means of providing the ancillary switch 7 into the accessory switch housing sections 1*a* and 1*b* without use of the alarm switch 9.

Problems to be Solved

The output signal transmission mechanism of related-art structure has the following problems:

(1) The pair of output protrusions 6*a* are formed in non-symmetrical positions on the open-close lever 6 so as to match the positions of operation levers of the ancillary switches 7 provided in the accessory switch housing sections 1*a* and 1*b*. For this reason, as shown in FIG. 8B, the output protrusion 6*a* assumes a complicated stepped geometry.

(2) The alarm output plate 8 is provided along the exterior of the frame of the open-close mechanism section 3 and effects guiding and supporting action in a vertically slidable manner without involvement of occurrence of interference with the open-close lever 6. By means of the a toggle shaft and a drive spring of the open-close mechanism which causes pivotal movement at the time of tripping operation, the alarm output plate 8 is actuated. Therefore, the alarm output plate 8 assumes a complicated geometry and a complicated guide mechanism. Hence, the number of parts constituting the alarm output plate 8, the number of processes for assembling the alarm output plate 8, and the space occupied by the alarm output plate 8 become large. In terms of operation, friction or abrasion of components of the guide mechanism stemming from sliding action is apt to cause resistance or rattle, thus posing difficulty in ensuring smooth operation over a long period of time.

SUMMARY OF THE INVENTION

The present invention has been conceived in light of the foregoing drawback and is aimed at solving the foregoing drawback and at providing an improved circuit breaker capable of accurately transmitting a mechanical signal output from a breaker main unit to an ancillary switch and an alarm switch provided in accessory switch housing sections of a breaker case, with use of a simple mechanism and stable operation.

Means for Solving the Problems

To achieve the object, the present invention provides a circuit breaker including:

a breaker case;

left-side and right-side accessory switch housing sections for housing accessory switches of cassette type; that is, an ancillary switch for detecting an ON/OFF state of a contact of a main circuit by means of an electric signal and an alarm switch for detecting tripping operation by means of an electric signal; the ancillary switch being opened/closed in conjunction with an output protrusion formed on an open-close lever of an open-close mechanism for opening/closing a contact of a main circuit; and the alarm switch being opened/closed in conjunction with an alarm output plate which operates in accordance with tripping action of the open-close mechanism, wherein a symmetrically bifurcated output protrusion is provided on the open-close lever so as to oppose an operation lever of the ancillary switch provided in the accessory switch storage section, and an extremity of the alarm output plate is caused to oppose an operation lever of the alarm switch which is provided as a pivotal lever coupled directly to the open-close mechanism and is to be provided in the accessory switch housing section in a direction orthogonal to the open-close lever.

Preferably, a case for an ancillary switch and a case for an alarm switch are made identical in shape with each other; a step is set between an operation lever of the ancillary switch protruding from a front surface of the case and an operation lever of the alarm switch, with reference to a thicknesswise direction of the cases. Further, the operation lever of the ancillary switch is caused to oppose a bifurcated output protrusion of the open-close lever and the operation lever of the alarm switch is caused to oppose an alarm output plate, while the ancillary switch and the alarm switch are provided in the breaker cases.

By means of the foregoing configuration, ends of the bifurcated output protrusion formed in the open-close lever correspond to the respective accessory switch housing sections formed on the breaker case. As a result, an ancillary switch may be provided in any one of the switch housing sections or in both the switch housing sections. Since the bifurcated output protrusion is formed symmetrically, the open-close lever per se assumes a simple geometry and can be manufactured inexpensively.

The alarm output plate is formed into a pivotal lever coupled directly to the open-close mechanism for opening/closing a contact of a main circuit. Hence, there is necessity for a complex linear guide mechanism, and accurate transmission of a mechanical signal output from the open-close mechanism to the alarm switch without involvement of transmission loss. Further, the lever-shaped alarm output plate can be made more compact than an alarm output plate of related-art structure. A step is provided between the operation lever of the ancillary switch and the operation lever of the alarm switch with reference to a thicknesswise direction of the circuit breaker. Hence, the lever-shaped alarm output plate can be arranged without involvement of occurrence of interference with the output protrusion of the open-close lever.

BRIEF DESCRIPTION OF THE DRAWINGS

FIGS. 1A and 1B are structural drawings showing the principal section of a circuit breaker according to an embodiment of the present invention, wherein FIG. 1A is an illustration showing an ancillary switch and an alarm switch when the switches are provided in combination in an accessory switch storage section of breaker cases, and FIG. 1B is a cross-sectional view of the circuit breaker shown in FIG. 1A when viewed in the direction designated by an arrow;

FIGS. 5A and 5B are external views showing the ancillary switch shown in FIGS. 1 and 2, wherein FIG. 5A is a front view and FIG. 5B is a side view;

FIGS. 6A and 6B are external views showing the alarm switch shown in FIGS. 1 and 2, wherein FIG. 6A is a front view and FIG. 6B is a side view;

FIGS. 7A and 7B are block diagrams showing a related-art molded case circuit breaker having an ancillary switch and an alarm switch provided as interior accessory devices, wherein FIG. 7A is a plan view and FIG. 7B is a side view; and FIGS. 8A, 8B and 8C are structural views showing an open-close mechanism section shown in FIGS. 7A and 7B, wherein FIG. 8A is an external perspective view showing an assembled state of the open-close mechanism section; and FIGS. 8B and 8C are perspective views showing an open-close lever and an alarm output plate shown in FIG. 8A.

DETAILED DESCRIPTION OF THE PREFERRED EMBODIMENTS

Mode for Implementing the Invention

Figure 7A:
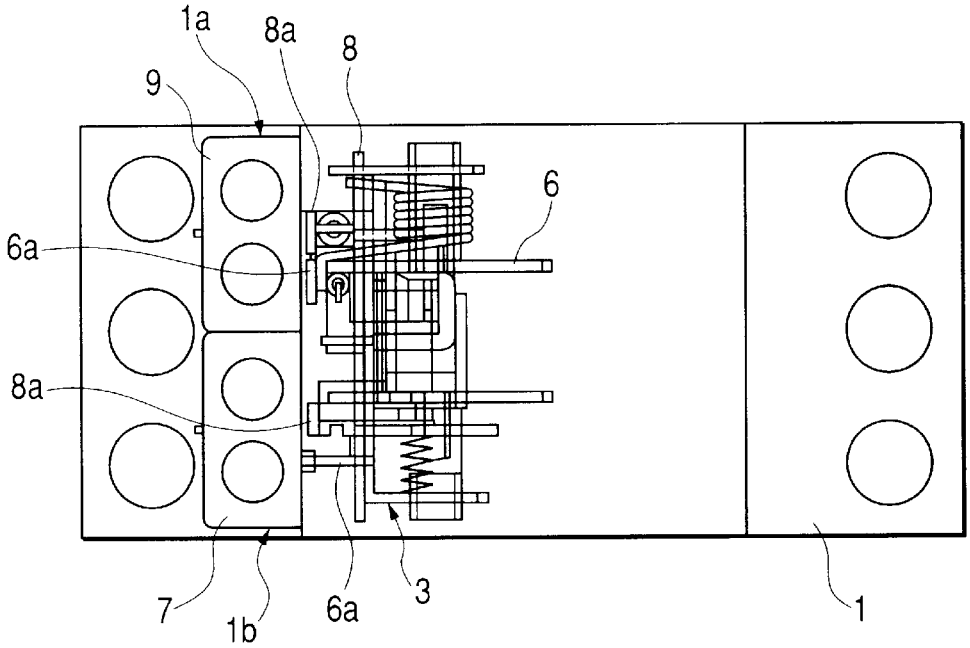
Figure 7B:
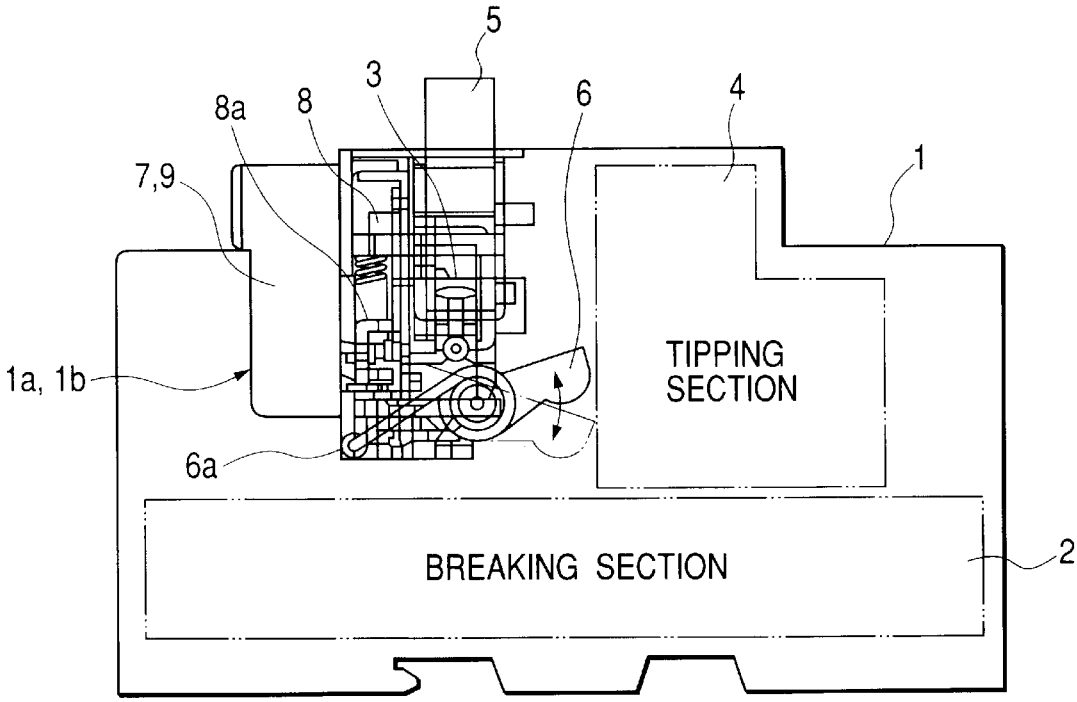
Figure 8A:
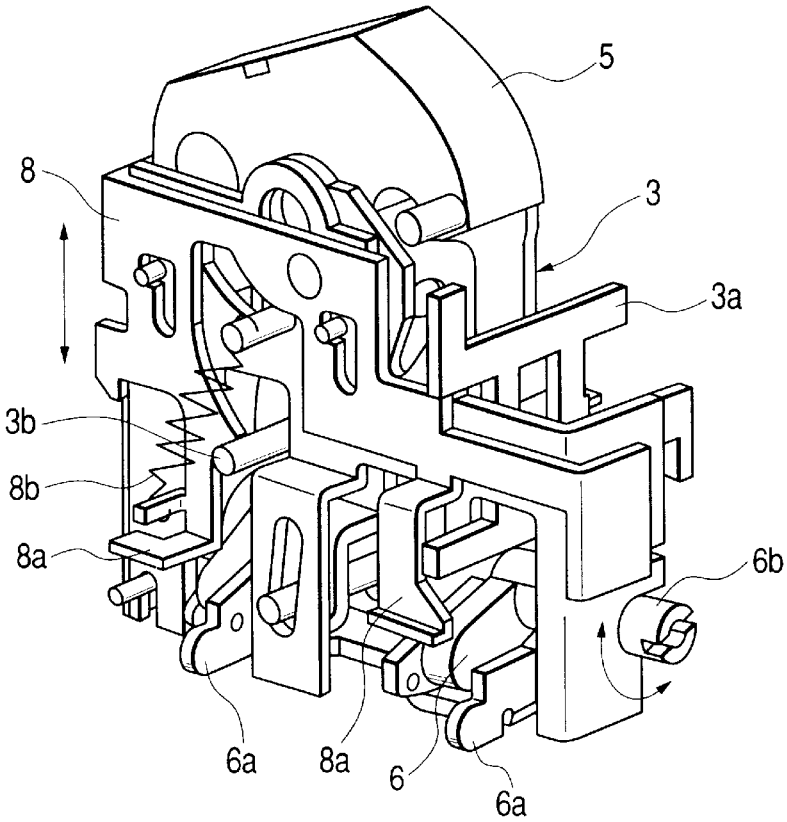
Figure 8B:
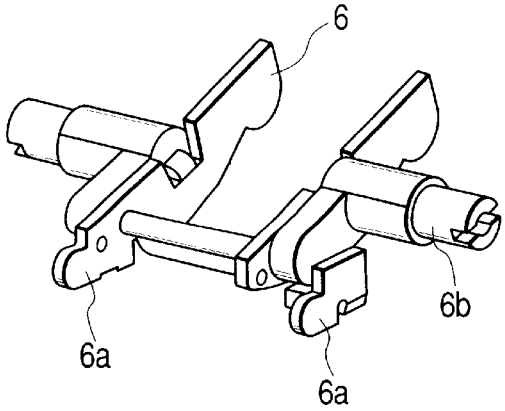
Figure 8C:
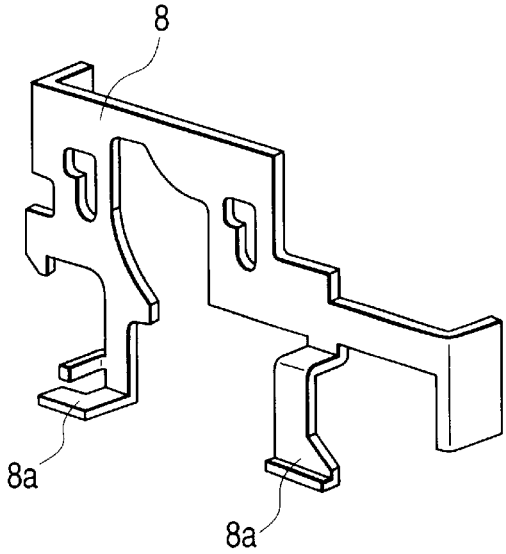

An embodiment of the present invention will be described herein below by reference to FIGS. 1 through 6B. In the drawings, those members which are the same as those shown in FIGS. 7 and 8 are assigned the same reference numerals, and their detailed explanations thereof are omitted.

Figure 1A:
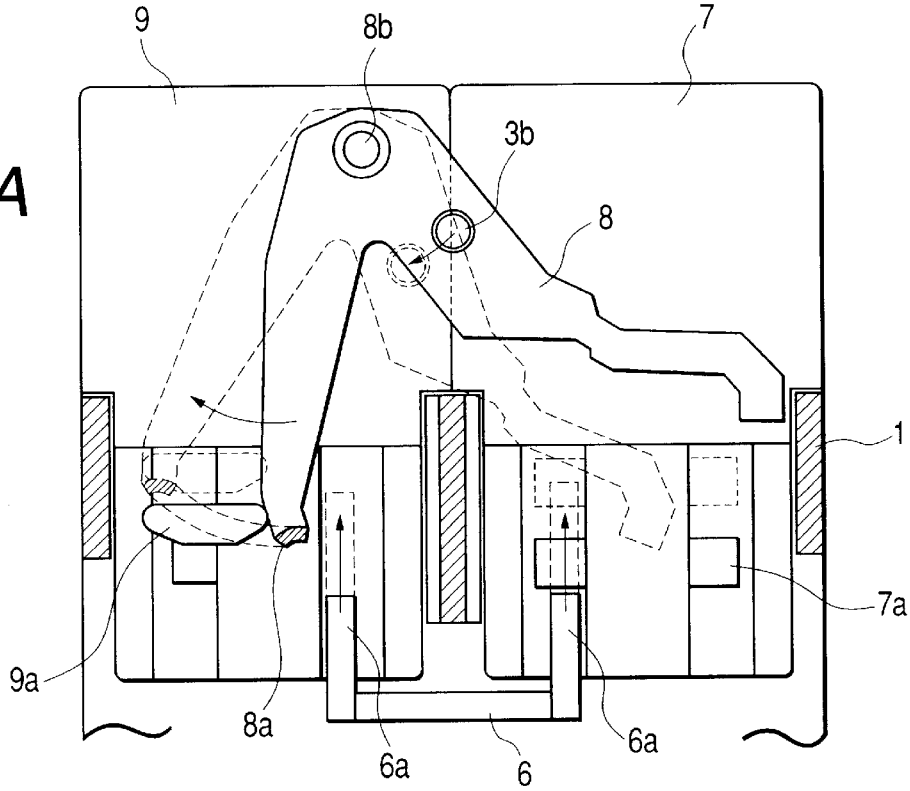
Figure 2:
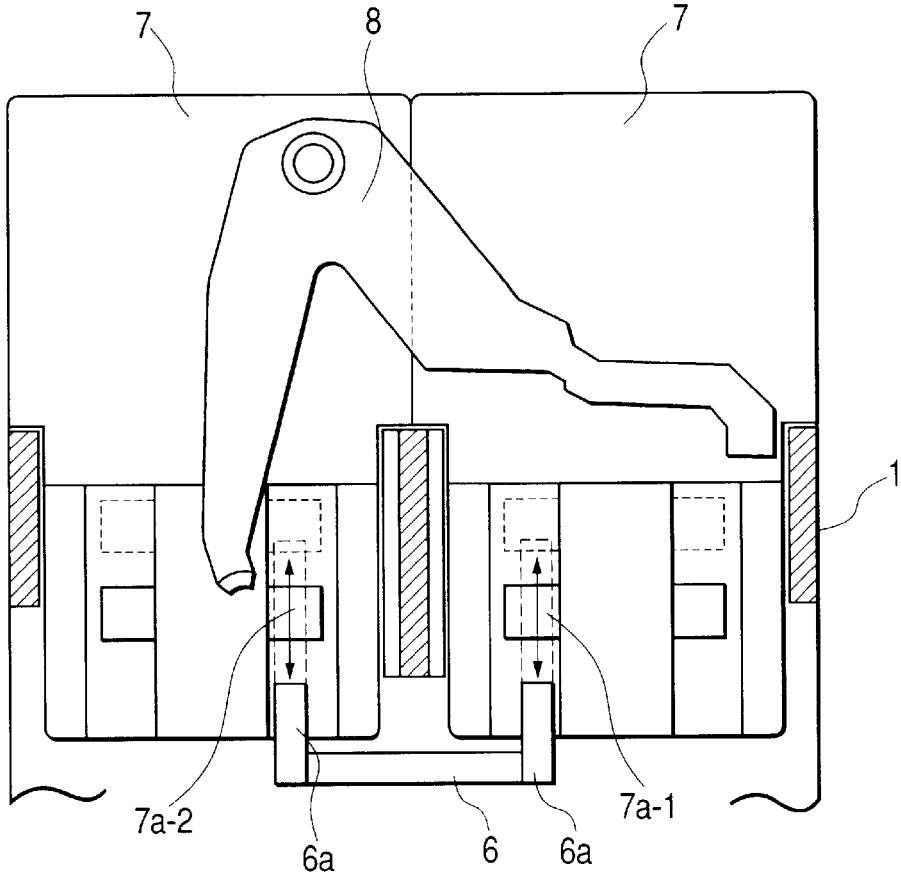
FIG. 2 is a structural view showing the principal section of the circuit breaker, wherein two ancillary switches are provided in combination in the accessory switch storage sections of the breaker case.
Figure 3:
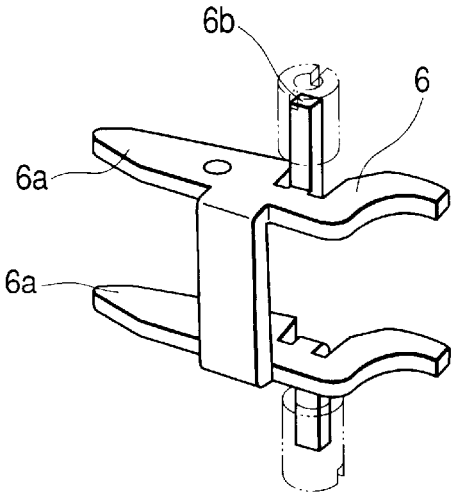
FIG. 3 is an external perspective view showing the open-close lever shown in FIGS. 1 and 2.

In the illustrated embodiment, as shown in FIG. 3, an open-close lever 6 is bifurcated into two output protrusions 6*a* in a symmetrical pattern. In a state in which the open-close lever 6 is attached to a breaker main unit, the output protrusions 6*a* are arranged in a symmetrical pattern with respect to a pair of accessory switch housing sections formed on the breaker case 1, as shown in FIGS. 1A and 2. The output protrusions 6*a* protrude downward toward the respective accessory switch housing sections.

Figure 4:
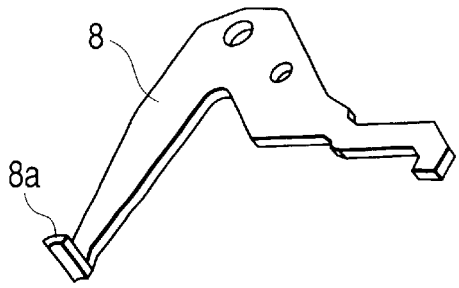
FIG. 4 is an external perspective view showing the alarm output plate shown in FIGS. 1 and 2.
Figure 5A:
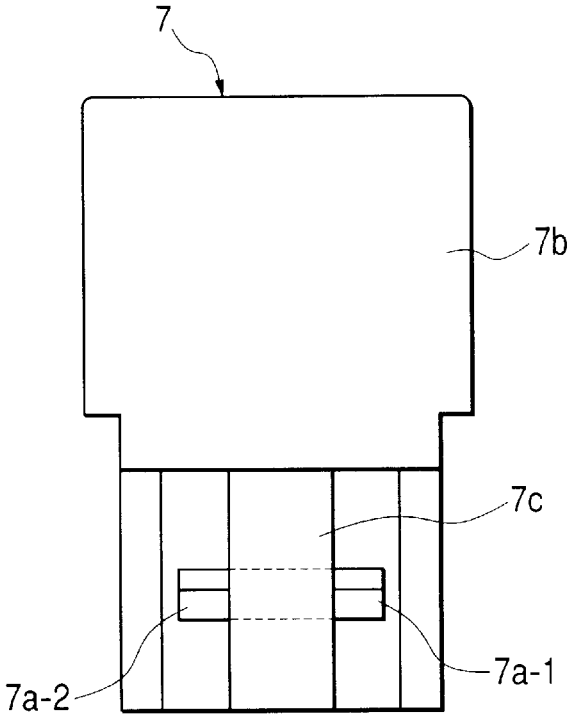
Figure 5B:
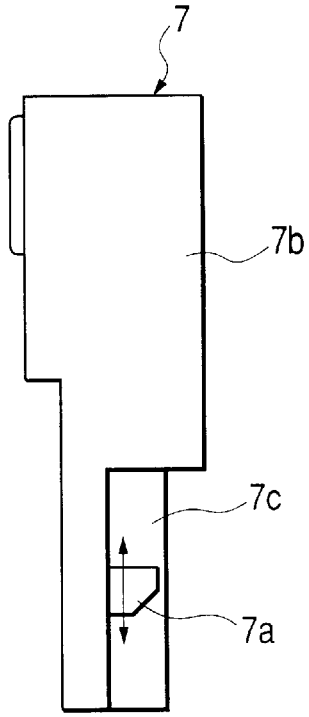
Figure 6A:
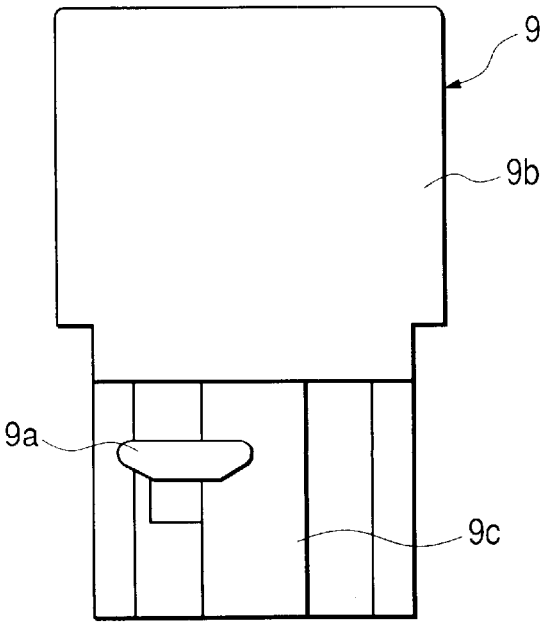
Figure 6B:
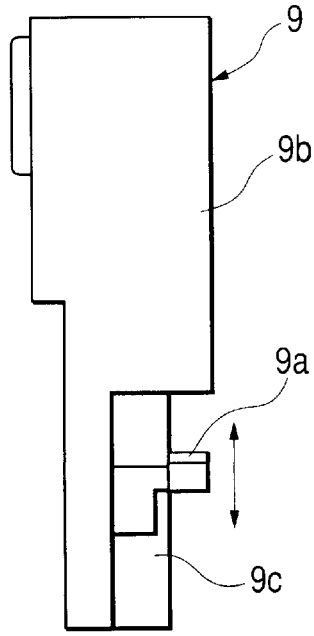

As shown in FIG. 4, the alarm output plate 8 assumes the shape of a reverse V-shaped pivotal lever. The alarm output plate 8 is placed in an upper position relative to the output protrusions 6*a* so as to avoid occurrence of interference with the output protrusions 6*a* of the open-close lever 6. The alarm output plate 8 is pivotally supported on the end face of the frame of the open-close mechanism section 3 via a spindle 8*b*. In this position, the alarm output plate 8 is coupled to a toggle shaft 3*b* projecting from the open-close mechanism section 3 (such that the alarm output plate 8 pivots in a clockwise direction when the breaker is tripped). An arm-shaped projection piece 8*a* formed at the extremity of the lever protrudes toward the left-side accessory switch housing section (see FIG. 1).

FIGS. 5A through 6B show the ancillary switch 7 and the alarm switch 9 provided in the accessory switch housing sections on the case 1. A case 7*b* of the ancillary switch 7 incorporating a contact mechanism and a case 9*b* of the alarm switch 9 are formed into common components of identical shape. A protruding step 7*c* is formed in the center of a lower half the front of the case 7*b* in a bulging manner, and a protruding step 9*c* is also formed in the center of a lower half of the front of the case 9*b* in a bulging manner. In relation to the ancillary switch 7, an operation lever 7*a* connected to a movable contact of the contact mechanism is bifurcated into two pieces 7*a*-1 and 7*a*-2 so as to straddle the protruding step 7*c*. An operation lever 9*a* of the alarm switch 9 is formed on the protruding step 9*c* formed in the center of the case in the shape of a horizontally-wide cam, so as to bulge forwardly. Accordingly, a step exists between the operation lever 7*a* of the ancillary switch 7 and the operation lever 9*a* of the alarm switch 9 in the thicknesswise direction of the circuit breaker.

Figure 1B:
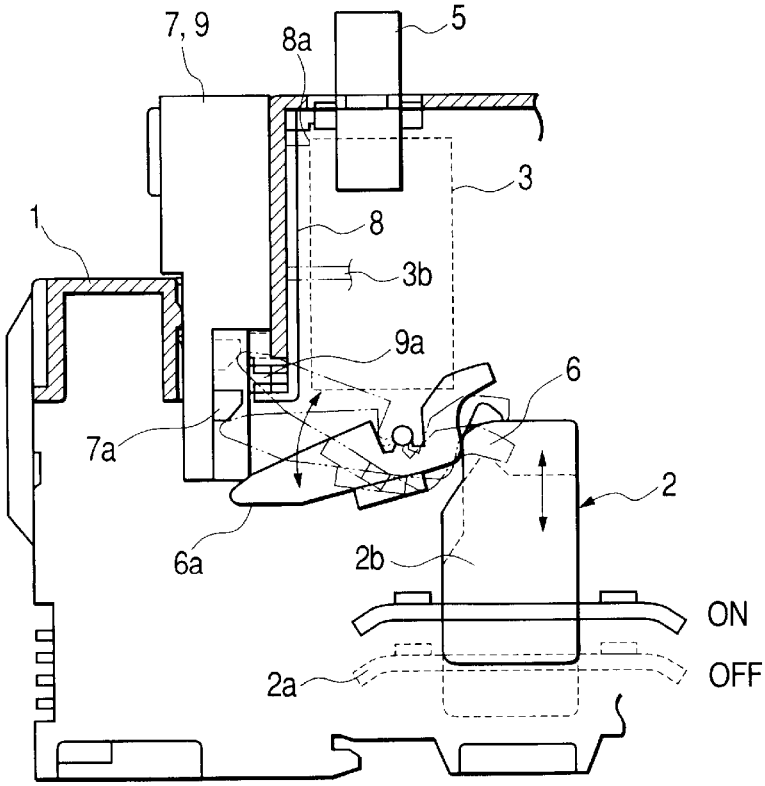

By reference to FIGS. 1A and 1B, there will be described the operation of the circuit breaker when the ancillary switch 7 and the alarm switch 9 are provided in combination in the accessory switch housing sections. More specifically, the ancillary switch 7 is set to the right-side accessory switch housing section, and the alarm switch 9 is inserted into the left-side accessory switching housing section. In this state, the operation lever 7*a* of the ancillary switch 7 opposes the output projection 6*a* of the open-close lever 6. Further, the operation lever 9*a* of the alarm switch 9 opposes the output projection 8*a* of the alarm output plate 8 in a forwardly-projecting position relative to the operation lever 7*a* of the ancillary switch 7.

When a handle 5 is actuated to an ON/OFF position, the open-close lever 6 is pivoted around a spindle 6*b* (see FIG. 3) in accordance with the action of the open-close mechanism section coupled to the handle 5. As a result, the movable contact 2*a* of the breaking section 2 vertically moves in conjunction with a contact holder 2*b*, thus turning ON/OFF a contact of the main circuit. In this case, when the movable contact 2*a* is located in an ON position where the contact of the main circuit is closed, the output projection 6*a* of the open-close lever 6 recedes to the position of a solid line shown in the drawing. As a result, the output projection 6*a* of the open-close lever 6 is spaced apart from the operation lever 7*a* of the ancillary switch 7. In contrast, when the handle 5 is switched to an OFF position, the open-close lever 6 is pivoted in a clockwise direction from the position of the solid line to the position of broken lines. During the course of pivotal movement, the open-close lever 6 presses the contact holder 2*b* of the breaking section 2, thus moving the movable contact 2*a* to an OPEN position. Further, the output protrusion 6*a* pushes upward the operation lever 7*a* of the ancillary switch 7, thus inverting the operation of the contact mechanism.

The alarm output plate 8 remains in a standby condition at the position of an illustrated solid line at all times. Here, when the circuit breaker performs a tripping operation, the toggle shaft 3*b* of the open-close mechanism 3 actuates the alarm output plate 8. As a result, the alarm output plate 8 is pivoted around a spindle 8*b* to the position of broken lines. During the course of pivotal movement of the alarm output plate 8, an output projection 8*a* provided at the extremity of the lever raises an operation lever 9*a* of the alarm switch 9, thus inverting the operation of the contact mechanism of the switch. In this case, the alarm output plate 8 serving as a pivotal lever does not interfere with the output protrusion 6*a* of the open-close lever 6 and the operation lever 7*a* of the ancillary switch 7. When the open-close lever 6 is pivoted in the clockwise direction as a result of tripping operation of the circuit breaker, thereby bringing the contact of the main circuit of the main circuit of the breaking section 2 to an OFF position, the operation of the ancillary switch 7 is inverted in conjunction with pivotal movement of the open-close lever 6.

FIG. 2 shows a state in which the alarm switch 9 shown in FIG. 1 is replaced with the ancillary switch 7 and two ancillary switches 7 are provided in combination in the ancillary switch housing sections of the breaker case 1. In the combined state, in relation to the ancillary switch 7 provided in the right-side storage section, an operation lever 7*a*-1 projecting leftward from the left-side of the protruding step (see FIGS. 5A and 5B) of the case opposes the right-side output protrusion 6*a* of the open-close lever 6. In relation to the ancillary switch 7 provided in the left-side storage section of the case, an operation lever 7*a*-2 projecting rightward from the left-side of the protruding step (see FIGS. 5A and 5B) of the case opposes the left-side output protrusion 6*a* of the open-close lever 6. In these positions, the operations of the ancillary switches 7 are inverted in accordance with ON/OFF switching action of the circuit breaker. Even when the positions of the two ancillary switches 7 attached to the breaker case 1 are interchanged, no change arises in the positional relationship between the two ancillary switches 7. Hence, the bifurcated output protrusions 6*a* of the open-close lever 6 oppose the operation levers 7*a*. In this case, the alarm output plate 8 remains in a standby condition at an illustrated position, thus obviating possibility of interference with the operation levers 7*a*-1 and 7*a*-2 of the ancillary switches 7 as well as with the output protrusion 6*a* of the open-close lever 6. The alarm output plate 8 is actuated by means of tripping operation of the circuit breaker. By means of the tripping operation of the circuit breaker, the alarm output plate 8 is actuated. Even when the alarm output plate 8 is shifted to the position of broken lines shown in FIG. 1A, no influence is exerted on the left-side ancillary switch 7.

Advantages of the Invention

As mentioned above, according to the configuration of the present invention, an ancillary switch and an alarm switch can be provided in combination within a breaker case as accessory switches of a circuit breaker (i.e., interior accessories). Bifurcated output projections are formed symmetrically, as a result of which the open-close lever assumes a simple geometry and can be manufactured less-costly. An alarm output plate is formed in the shape of a pivotal lever coupled directly to a mechanism of opening/closing a contact of the main circuit, thus obviating a necessity for a complicated linear guide mechanism, which has been required hitherto. A mechanical signal output from the open-close mechanism can be transmitted accurately to the alarm switch without involvement of transmission loss. Signal transmission components are simpler in structure than counterpart related-art components. Even in terms of operation, there liability of the signal transmission components can be improved.

In relation to an ancillary switch and an alarm switch to be provided in the circuit breaker, breaker cases to be used for the switches are made identical in shape with each other. Further, a step is set between an operation lever of the ancillary switch protruding from the front surface of the case and an operation lever of the alarm switch, with reference to the thicknesswise direction of the case. While the switches remain attached to the breaker case, the operation lever of the ancillary switch is caused to oppose the bifurcated output protrusion of the open-close lever. Further, the operation lever of the alarm switch is caused to oppose the alarm output plate. Thus, transmission of a mechanical signal to the ancillary switch and the alarm switch can be effected while an attempt is made to realization of commonality of components of accessory switches, thus avoiding occurrence of interference between the output protrusion of the open-close lever and the alarm output plate.

What is claimed is:

1. A circuit breaker comprising:

a breaker case;

an ancillary switch for detecting an ON/OFF state of a contact of a main circuit, an alarm switch for detecting tripping operation;

a pair of left-side and right-side accessory switch housing sections for housing said ancillary switch and said alarm switch, the ancillary switch and the alarm switch being cassette type switches; wherein said ancillary switch is provided on said breaker case and is opened/closed in conjunction with an output protrusion formed on an open-close lever of an open-close mechanism for opening/closing a contact of a main circuit;

said alarm switch is provided on said breaker case and is opened/closed in conjunction with an alarm output plate which operates in accordance with tripping action of the open-close mechanism;

a symmetrically bifurcated output protrusion is provided on said open-close lever to oppose an operation lever of said ancillary switch provided in either one of said leftside and right-side accessory switch housing sections; and an extremity of said alarm output plate is caused to oppose an operation lever of said alarm switch which is provided as a pivotal lever coupled directly to the open-close mechanism and is to be provided in said accessory switch housing section in a direction orthogonal to said open-close lever.

2. A circuit breaker comprising:

a breaker case;

an ancillary switch for detecting an ON/OFF state of a contact of a main circuit, an alarm switch for detecting tripping operation;

a pair of left-side and right-side accessory switch housing sections for housing said ancillary switch and said alarm switch, the ancillary switch and the alarm switch being cassette type switches; wherein said ancillary switch is provided on said breaker case and is opened/closed in conjunction with an output protrusion formed on an open-close lever of an open-close mechanism for opening/closing a contact of a main circuit;

said alarm switch is provided on said breaker case and is opened/closed in conjunction with an alarm output plate which operates in accordance with tripping action of the open-close mechanism;

a symmetrically bifurcated output protrusion is provided on said open-close lever to oppose an operation lever of said ancillary switch provided in either one of said leftside and right-side accessory switch housing sections; and an extremity of said alarm output plate is caused to oppose an operation lever of said alarm switch which is provided as a pivotal lever coupled directly to the open-close mechanism and is to be provided in said accessory switch housing section in a direction orthogonal to said open-close lever; wherein a case for said ancillary switch and a case for said alarm switch are made identical in shape with each other;

a step is set between an operation lever of said ancillary switch protruding from a front surface of said case and an operation lever of said alarm switch, with reference to a thicknesswise direction of said cases; and said operation lever of said ancillary switch is caused to oppose a bifurcated output protrusion of said open-close lever and said operation lever of said alarm switch is caused to oppose an alarm output plate, while said ancillary switch and said alarm switch are provided in said breaker cases.

* * * * *

UNITED STATES PATENT AND TRADEMARK OFFICE

CERTIFICATE OF CORRECTION

PATENT NO. : 6,559,745 B2
DATED : May 6, 2003
INVENTOR(S) : Yamagata et al.

It is certified that error appears in the above-identified patent and that said Letters Patent is hereby corrected as shown below:

Title page,
Item [73] Assignee, please delete "Kanagausa", and insert therefor -- Kanagawa --.

Column 4,
Line 46, please delete "herein below", and insert therefor -- hereinbelow --.

Column 6,
Line 66, please delete "there liability", and insert therefor -- the reliability --.

Column 7,
Line 41, please delete "leftside", and insert therefor -- left-side --.

Column 8,
Line 24, please delete "leftside", and insert therefor -- left-side --.

Signed and Sealed this

Ninth Day of September, 2003

JAMES E. ROGAN
*Director of the United States Patent and Trademark Office*